US007980533B1

(12) United States Patent
Anderson et al.

(10) Patent No.: US 7,980,533 B1
(45) Date of Patent: Jul. 19, 2011

(54) BREAKAWAY COUPLING FOR ROAD-SIDE SIGNS

(75) Inventors: Jim Anderson, Stillman Valley, IL (US); Harry M Travis, Milton, WI (US)

(73) Assignee: Designorations, Inc., Stillman Valley, IL (US)

( * ) Notice: Subject to any disclaimer, the term of this patent is extended or adjusted under 35 U.S.C. 154(b) by 0 days.

(21) Appl. No.: 11/070,823

(22) Filed: Mar. 2, 2005

Related U.S. Application Data

(60) Provisional application No. 60/549,389, filed on Mar. 2, 2004.

(51) Int. Cl.
*E01F 9/018* (2006.01)
*E01F 15/00* (2006.01)

(52) U.S. Cl. .. 256/13.1; 404/10; 40/607.04; 256/DIG. 5

(58) Field of Classification Search ..... 256/13.1, 256/DIG. 5; 403/2; 40/607.02–607.06; 52/98, 52/100; 248/548, 900, 909; 404/6, 9, 10
See application file for complete search history.

(56) References Cited

U.S. PATENT DOCUMENTS

| | | | | | |
|---|---|---|---|---|---|
| 3,628,296 | A * | 12/1971 | Henry | 52/98 |
| 3,912,405 | A * | 10/1975 | Katt | 403/2 |
| 4,105,350 | A * | 8/1978 | O'Donnell | 403/220 |
| 4,926,592 | A * | 5/1990 | Nehls | 52/98 |
| 5,855,443 | A * | 1/1999 | Faller et al. | 403/2 |
| 5,860,253 | A * | 1/1999 | Lapointe | 52/98 |
| 6,065,894 | A * | 5/2000 | Wasson et al. | 403/2 |
| 6,508,457 | B1 * | 1/2003 | Knudson et al. | 256/65.01 |
| 6,516,573 | B1 * | 2/2003 | Farrell et al. | 52/98 |
| 6,540,196 | B1 * | 4/2003 | Ellsworth | 248/548 |
| 6,959,902 | B2 * | 11/2005 | Leahy | 248/548 |
| 2001/0032918 | A1 * | 10/2001 | Barnes et al. | 248/548 |
| 2002/0121035 | A1 * | 9/2002 | Dicke et al. | 40/610 |
| 2003/0183740 | A1 * | 10/2003 | Knapp et al. | 248/548 |
| 2006/0228165 | A1 * | 10/2006 | Yonan, III | 403/2 |

* cited by examiner

*Primary Examiner* — Joshua T Kennedy

(57) ABSTRACT

A breakaway coupling for use with a ground-installed road sign such as a stop sign typically located at the side of a road. The coupling interfaces between a conventional hollow ground stake and a hollow sign post. The coupling can be used with newly installed stop signs, as well as with currently installed stop signs, without modification to either the post of the ground stake. When the sign post is struck by an automobile, the coupling shears along a preformed score section generally aligned with the bottom of the post such that the post and sign break completely from the ground stake and are propelled away from the automobile.

14 Claims, 6 Drawing Sheets

FIG. 1
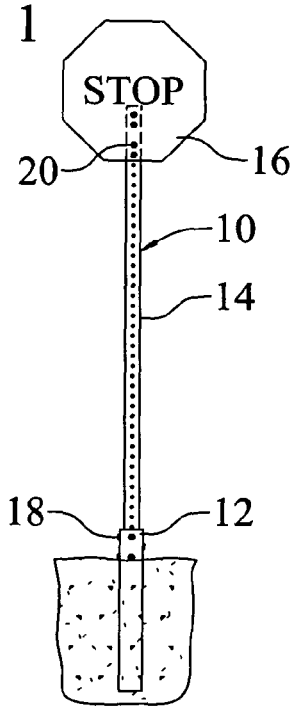
FIG. 3
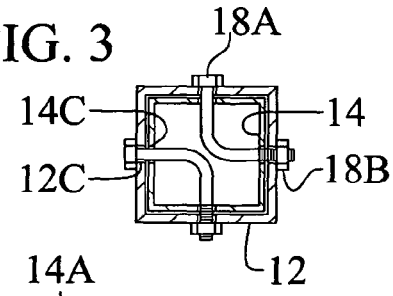
FIG. 2
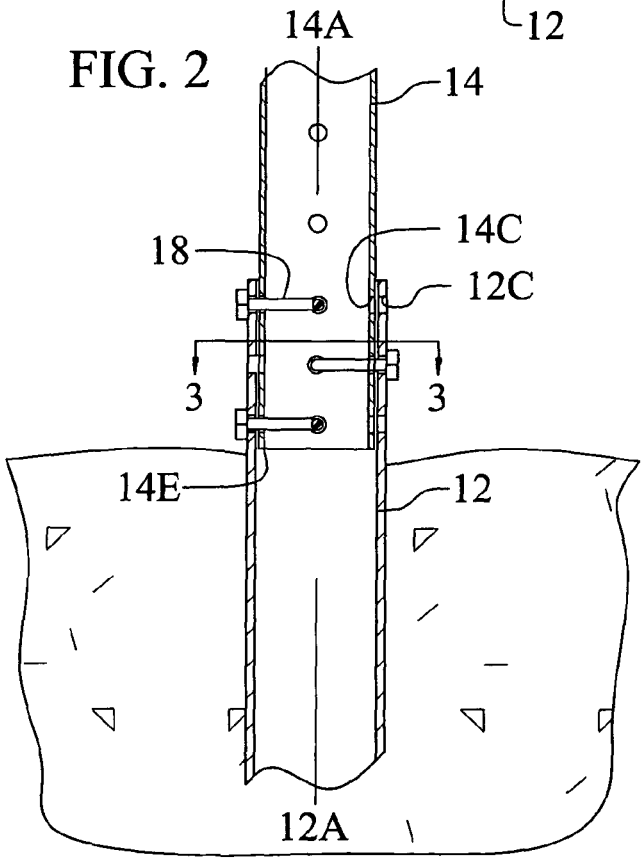
PRIOR ART
FIGS. 1-4
FIG. 4
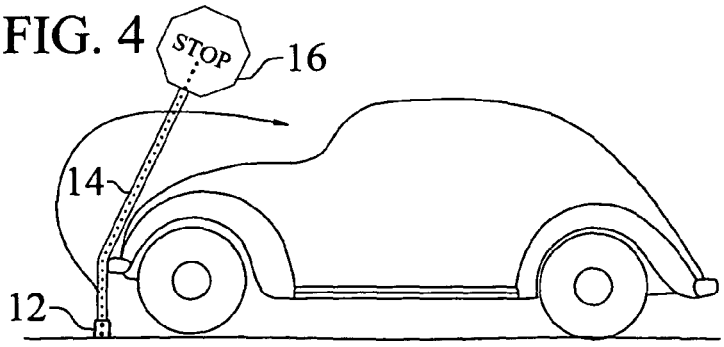

BREAKAWAY COUPLING FOR ROAD-SIDE SIGNS

CROSS-REFERENCES TO RELATED APPLICATIONS

This application claims priority to U.S. Provisional Patent Application Ser. No. 60/549,389 filed Mar. 2, 2004.

INCORPORATION-BY-REFERENCE OF MATERIAL SUBMITTED ON A COMPACT DISC

Not applicable.

STATEMENT REGARDING FEDERALLY SPONSORED RESEARCH OR DEVELOPMENT

Not applicable.

BACKGROUND OF THE INVENTION

1. Field of Invention

The present invention relates to couplings to facilitate clean breakaway of road-side signs of the type carried on posts if the posts are struck by an automobile.

2. Description of Prior Art

Stop signs, as well as many other road side signs, are conventionally installed with a ground stake (or anchor), a square sign post, the sign, a set of angled fasteners, and a set of straight fasteners. The ground stake is hollow steel tube construction, with an approximately square (i.e., square or rectangular, hereinafter referred inclusively as square) cross-section profile, and is installed into the ground in a vertical position with approximately zero to four inches of the stake extending above the ground. The sign post is also hollow steel tube construction, with an approximately square cross-section profile. The bottom of the sign post is snugly slipped into the top of the ground stake, and is secured in the ground stake with the angled fasteners extending through aligned clearance holes in the top of the post and the bottom of the ground stake. The sign is secured to the top of the post with the straight fasteners. Details of a conventionally installed stop sign are discussed further below and shown in the drawings in FIGS. 1-3.

The currently used telescoping posts were approved by the FHWA in 1986. However, they are not a breakaway system in that at speeds over 30 mph the signpost when struck by a vehicle will come back on the vehicle and will likely penetrate the windshield or roof causing possible occupant injury. At slow speeds the signpost may fall forward but become lodged in the ground anchor making it difficult to remove. In both cases the anchor becomes disfigured and will need to be replaced.

More particularly, experience shows that such conventionally installed road side signs present the potential for damage to an automobile that strikes the post, and the potential for injury to occupants of the automobile. As illustrated in FIG. 4 of the drawings, when an automobile strikes a conventionally installed stop sign post, particularly when struck at speeds of greater than approximately 30 miles per hour, there is a potential that the sign post will bend back towards the automobile, sending the sign towards the automobile and its occupants. Numerous accidents are recorded each year in which stop signs slam back into the roof of a car that strikes the sign post head-on, potentially piercing through the roof, and/or back through the windshield. These scenarios present a genuine danger of injury to the occupants of the vehicle.

Prior sign post breakaway coupling arrangements tend to be relatively complicated and correspondingly expensive. Some prior sign post breakaway couplings require modification to the ends of the conventional ground stake and/or the conventional sign post noted above, and/or require rivets or special fasteners and/or special tools for installation of the coupling to the post and the ground stake, and for removal of the post and coupling from the ground stake.

The National Cooperative Highway Research Program (NCHRP) Report 350, *Recommended Procedures for the Safety Performance Evaluation of Highway Features*, specifies the generally accepted breakaway performance criteria of breakaway couplings for road signs.

There is a need for a new breakaway coupling for installing road-side signs that reduces the dangers associated with striking a conventionally installed stop sign, and that is relatively simple in construction and installation, and correspondingly less expensive as compared with prior breakaway couplings. There would also be cost and safety advantages if such a technique or device could be used with both newly installed stop signs and retrofit to currently installed signs without the need to modify either the ground stake or the sign post.

SUMMARY OF THE INVENTION

The primary objective of the present invention is to provide a new and unique coupling for use when installing a road-side sign, the coupling being uniquely configured to facilitate clean breakaway of the sign and sign post from the ground stake if the sign post is struck by an automobile.

Another important objective of the invention is to provide such a coupling that is low cost to manufacture and easy to use, without resulting in the need for additional expense beyond the simple coupling.

Another important objective of the invention is to provide such a coupling that is suitable for use with both newly installed road-side signs and currently installed signs without modification to either the post or the ground stake of such conventionally or currently installed signs.

Another important objective of the invention is to prevent the anchor (i.e., ground stake) from disfiguring from an impact, by providing such a coupling that quickly and cleanly shears when the sign post is struck by an automobile, thereby protecting against damage to the anchor. With prior coupling, the inability to quickly and cleanly shear results in damage or disfigurement to the anchor, This necessitates removing the anchor and installing a new one which results in further costs in time and money with prior arrangements, and corresponding savings with the present invention.

These and other objectives and advantages of the invention will become more apparent from the following detailed description when taken in conjunction with the accompanying drawings.

Briefly, a breakaway coupling in accordance with the invention is adapted for securing a sign post with a bottom having first and second oppositely facing sides to a ground stake with a top having third and fourth oppositely facing sides. In accordance with one aspect of the invention, a breakaway coupling includes: (a) an upper section having a first side with a profile that is complimentary to the first side of the sign post for substantial face-to-face engagement therewith; (b) a lower section having a third side with a profile complimentary to the third side of the ground stake for substantial face-to-face engagement therewith; (c) a generally planar center section integrally established between the upper and lower sections, the center section extending outwardly from the first and third sides of the upper and lower sections, respectively, to establish a shoulder capable of resting against the top of the ground post when the lower section is in said engagement therewith and capable of engaging the bottom of the sign post when the upper section is in said engagement therewith; and (d) means for removably securing the upper and lower sections into said engagement with the sign post and ground stake, respectively; (e) wherein the transition between the center section and one of the upper and lower sections are provided with a reduced wall thickness as compared to the wall thickness at the transition between the center section and the other of the upper and lower sections to establish a shear plane at the reduced wall thickness transition. In preferred embodiments, the upper and lower sections of the breakaway coupling are formed with substantially equal wall thickness, and a score is defined inwardly at the transition of the center section and one of the upper and lower sections to establish a reduced thickness shear plane.

For use with square, tubular sign posts and ground stakes, the upper and lower sections of a preferred breakaway coupling are formed with outer profiles having (a) four equally spaced corners and side portions extending at right angles therefrom to establish overall approximately square cross-sections for telescoping into the square tubular sign post bottom and ground stake top, and (b) side portions extending from adjacent corners of the upper section and the lower section to establish engagement with the inside surface(s) of the tubular sign post and ground stake when secured therein. A preferred square coupling is further provided such that the cross-section of the upper and lower sections are generally X-shaped, with first and second legs extending between opposite corners and merging in the middle, and in which said score is established in the transition between the center section and said one section at all four of said corners and the side portions extending therefrom but not in said legs. In this instance, the coupling is further preferably provided with clearance holes in one of the legs of the upper and lower sections for securing means such as threaded fasteners to pass through, with the thickness of the one legs being thicker than the other legs to establish approximately equal material strength shear of all legs. For additional stiffness, the upper and lower sections may be formed with substantially closed top and bottom.

Currently preferred breakaway couplings are integrally molded from ASTM A4B Grey Iron.

For use with an approximately 2×2 inch square post, the outer profile of the upper section of one preferred coupling is approximately one and three-fourths (1¾) inch square, the center section is approximately two and one-fourth (2¼) inch square and approximately one-fourth (¼) inch thick, the outer profile of the lower section is approximately two (2) inches square, the overall height upper, center and lower section is approximately six (6) inches with the upper and lower sections having approximately the same height, one set of the legs of the X-shaped cross-section is provided with a thickness of approximately one-half (½) inch and with approximately one-fourth (¼) inch diameter clearance holes for threaded fasteners to secure the coupling in position between the post and stake, and the other set of legs is provided with a thickness of approximately one-eight (⅛) inch.

In an alternate embodiment, the upper and lower sections are formed with semi-circular outer profiles to establish overall approximately round cross-sections for telescoping into an approximately round tubular sign post bottom and an approximately round tubular ground stake top, respectively, whereby the semi-circular outer profiles establish sides of the upper and lower sections for engagement with inwardly facing sides of round tubular sign post bottom and round tubular ground stake top. In this instance, the upper and lower sections are preferably provided with clearance holes through the semi-circular profiles for fasteners to secure the coupling to the sign post and ground stake. The coupling may further include bosses aligned with the clearance holes at the inner profiles of the semi-circular profiles to provide additional strength and a flat surface for the threaded fasteners.

In one embodiment of such couplings, the semi-circular profiles extend through approximately 180 degrees, and the score is established around the entire transition between the center section and one of the semi-circular profiles.

In yet another alternate embodiment, the upper and lower sections of the breakaway coupling are formed with U-channel cross-sections having front sides for engaging back sides of a sign post bottom and a ground stake top, respectively, with approximately U-channel cross-sections. In this instance, the upper and lower sections are provided with clearance holes through the front sides of the U-channel cross-sections for fasteners to secure the coupling to the sign post and ground stake. The coupling may be further include bosses aligned with the clearance holes at the back sides of said U-channel cross-sections to provide additional strengths to support the fasteners.

BRIEF DESCRIPTION OF THE DRAWINGS

FIG. 1 is a front elevation view of a conventionally installed stop sign.

FIG. 2 is an enlarged side cross-sectional view of certain parts of the conventionally installed sign of FIG. 1, showing the base of a sign post as conventionally installed into a ground stake.

FIG. 3 is a top cross-sectional view taken along the line 3-3 of FIG. 2.

FIG. 4 is a side view of a typical scenario associated with an automobile striking into a conventionally installed stop sign.

Figure 5:
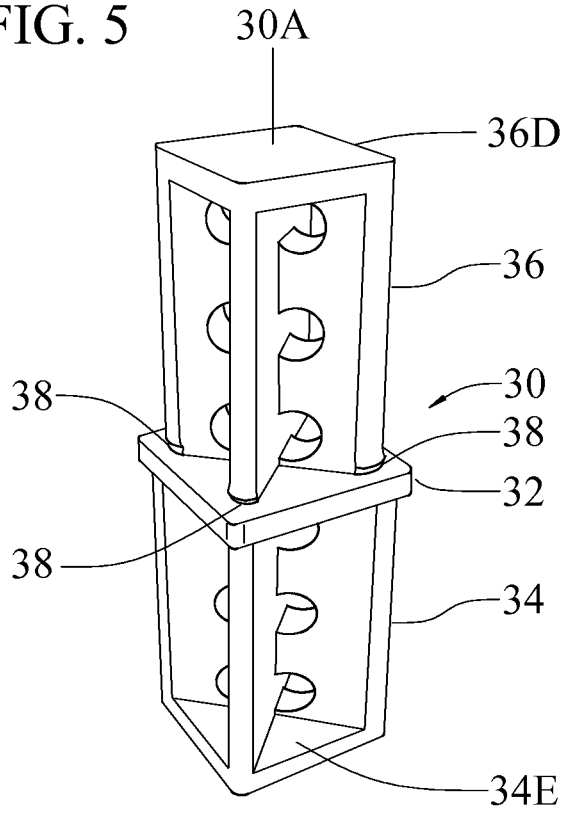
FIG. 5 is a perspective view of a breakaway coupling in accordance with the invention.
Figure 8:
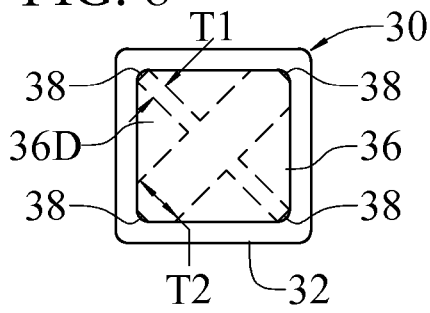
FIG. 8 is a top view of the breakaway coupling.
Figure 9:
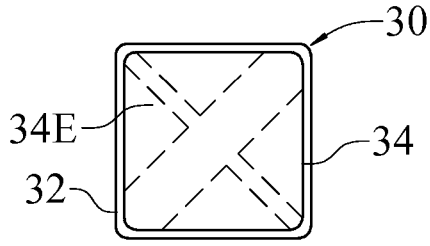
FIG. 9 is a bottom view of the breakaway coupling.
Figure 6:
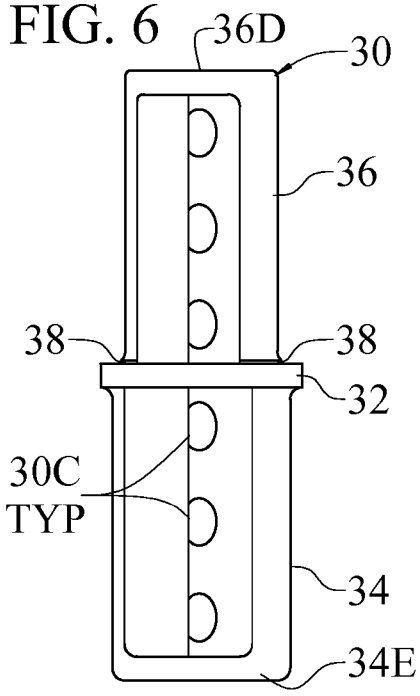
FIG. 6 is a first side view of the breakaway coupling shown in FIG. 5, the opposite side view being identical to the view shown.
Figure 7:
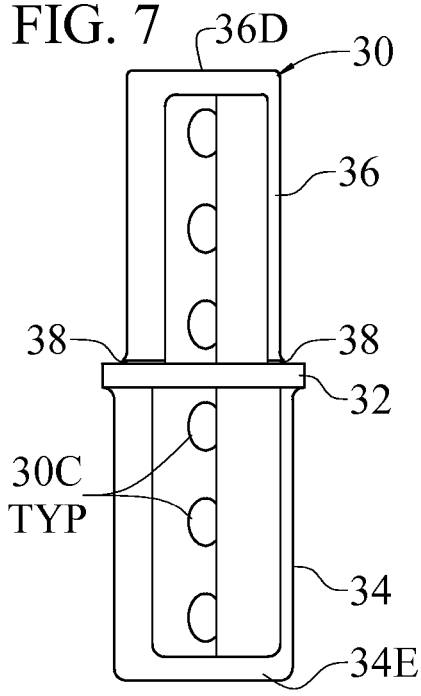
FIG. 7 is a second side view, orthogonal to the first side view of FIG. 6, of the breakaway coupling, the opposite side view being identical to the view shown.
Figure 12:
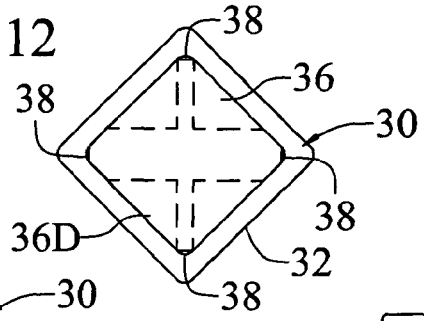
FIG. 12 is a top view of the breakaway coupling shown in the rotated position of FIG. 11.
Figure 10:
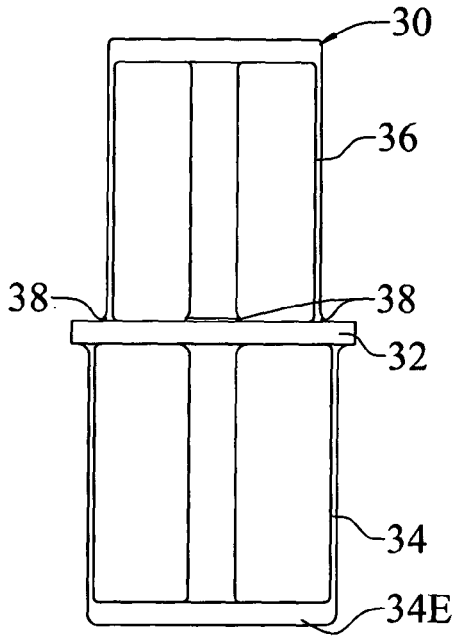
FIG. 10 is a side view of the breakaway coupling rotated 45 degrees from the side view shown in FIG. 6, the opposite side view being identical to the view shown.
Figure 11:
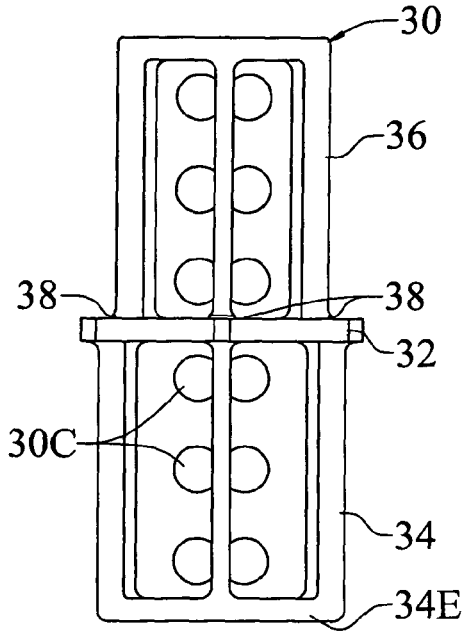
FIG. 11 is a side view, orthogonal to the side view of FIG. 10, of the breakaway coupling, the opposite side view being identical to the view shown.
Figure 13:
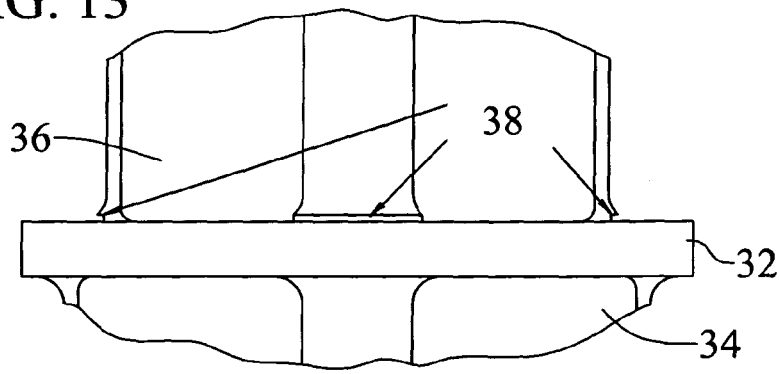
FIG. 13 is an enlarged fragmentary view of the center portion of the breakaway coupling as rotated in FIG. 10.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

A stop sign 10 as conventionally installed is shown in FIG. 1 and includes a ground stake 12, a sign post 14, a stop sign 16, a set of angled fasteners 18 (FIG. 2), and a set of straight fasteners 20.

The ground stake 12 (or ground socket or anchor), is of hollow tubular steel construction, extending longitudinally along a center axis 12A through the hollow center of the tube, with an approximately square cross-section profile (see FIG. 3) perpendicular to the center axis thereof. The ground stake is installed into the ground in a vertical position, with the center axis vertical as shown, so that between approximately zero to four inches of the stake extends above the ground. The four side walls at the top of the ground stake are provided with sets of through holes 12C that are approximately centered in the width of each side, aligned in the sides at the same axial position on the stake, and therefore at the same height on the sides when the stake is installed into the ground.

The sign post 14 is also of hollow tubular steel construction, extending longitudinally along a center axis 14A through the hollow center of the tube, with an approximately square cross-section profile perpendicular to the center axis thereof. The outside of the bottom 14E of the sign post is sized to slidably telescope into the top of the ground stake 12. The sign post is installed snugly into the ground stake to extend vertically from the ground stake. The four side walls at the bottom of the sign post are provided with sets of through holes 14C that are approximately centered in the width of each side, aligned in the sides at the same axial position on the sign post for alignment with the sets of corresponding holes 12C in the ground stake. The top of the sign post is also provided with through holes for securing the stop sign thereto with the fasteners 20 extending through clearance holes in the sign. The conventional sign post is provided with clearance holes 14C spaced at, for example, approximately one inch between centers, along the entire length of the post.

The angled fasteners 18 consist of 90 degree threaded angle bolts 18A (see FIG. 3) and conventional threaded nuts 18B. With the bottom of the sign post 14 installed into the top of the ground stake 12, the angled threaded fasteners are inserted through aligned holes 12C, 14C through two adjacent sides in the sign post and ground stake as shown in FIGS. 2 and 3 to secure the sign post in position in the ground stake.

Experience shows that stop signs installed with the above-described conventional method present the potential for damage to an automobile that strikes the post, and the potential for injury to occupants of the automobile. When struck at low speeds, the conventionally installed stop sign post will bend forwardly, resulting in the potential that the vehicle will drive up onto or over the stop sign, which may extend upwardly at a dangerous angle from proximate the ground, and the resulting potential damage to the vehicle. As illustrated in FIG. 4, when an automobile strikes a conventionally installed stop sign post at a speed, such as approximately 30 miles per hour or greater, there is a further potential that the sign post will bend back towards the automobile, directing the stop sign towards the automobile and its occupants. Numerous accidents are recorded each year in which stop signs slam back into the roof of the car, potentially piercing through the roof, and/or back through the windshield. One source for data on these types of accidents is report CMS No. 2005.00101 from the National Center for Statistics and Analysis (NCSA) which is part of the National Highway Traffic Safety Administration (NHTSA) Information Services.

Figure 14:
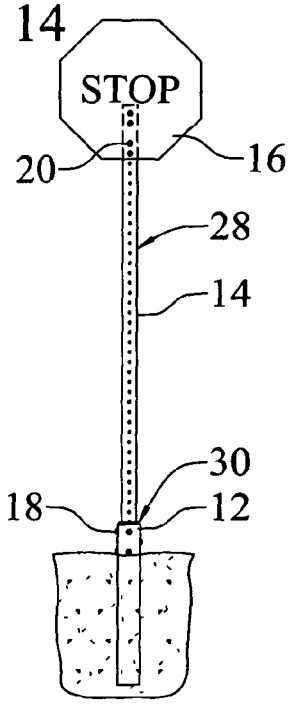
FIG. 14 is a front elevation view of a stop sign installed with the breakaway coupling according to the invention.

A stop sign 28 installed in accordance with the invention (see FIGS. 14-15) includes the ground stake 12, the sign post 14, the stop sign 16, the angled fasteners 18, and the straight fasteners 20 as described above.

In accordance with the invention, a uniquely configured coupling 30 is provided to establish a clean breakaway of the sign post 14 and stop sign 16 from the ground stake 12 if the sign post is struck with an automobile. The breakaway coupling is configured as provided below to shear if the sign post is struck with an automobile having a speed of at least approximately 15 miles per hour, or greater, and is preferably configured to breakaway when struck by an automobile at virtually any speed.

The coupling 30, as shown in detail in FIGS. 5-13, includes a center section 32 with top and bottom shoulders or generally planar oppositely facing (up and down) surfaces, a lower section 34 extending downwardly from the bottom of the center section, an upper section 36 extending upwardly from the top of the center section, and a score formation 38 extending around the coupling at the transition interface between the top and center section. The coupling 30 extends longitudinally along a center axis 30A. The preferred coupling is manufactured as a one-piece unit, with the upper section and lower section of the coupling being integrally formed together, and as discussed further below, is preferably formed as a molded part.

Figure 15:
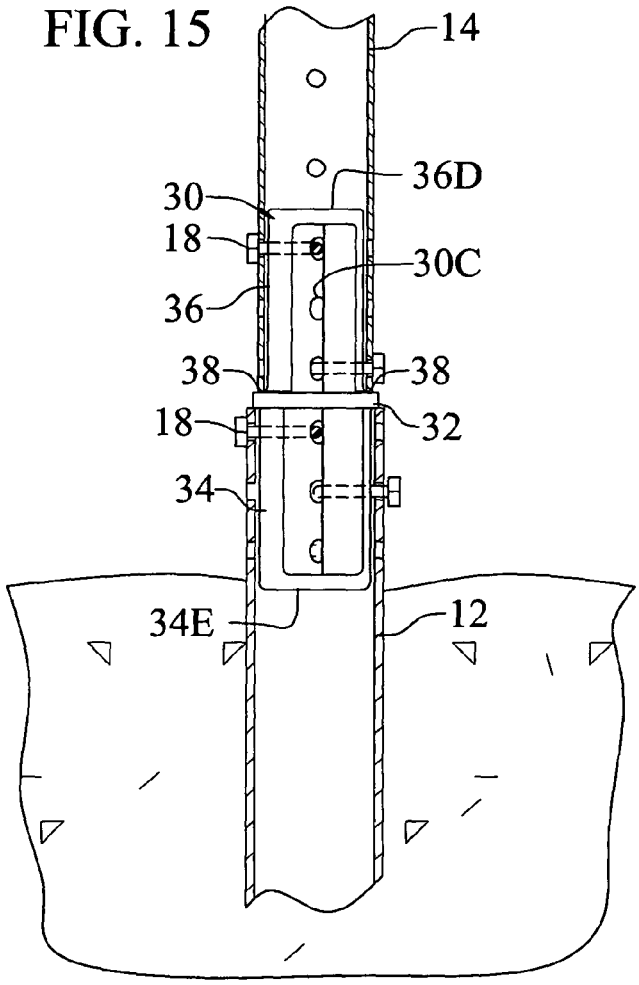
FIG. 15 is an enlarged side cross-sectional view similar to FIG. 2 of the stop sign installed with the breakaway coupling as shown in FIG. 14.

As shown in FIG. 15, the outside profile of the lower section 34 is sized to slidably telescope into the top of the ground stake 12, to a depth of preferably at least approximately two to three inches. The cross-section outside profile of the lower section is configured to prevent rotation of the coupling in the ground stake. The inside profile of the lower section is configured for allowing angle threaded fasteners 18 to extend therethrough and through aligned holes 12C in the sides of the ground stake top. The preferred outer profile of the lower section is an approximately square profile perpendicular to the center axis thereof for a snug fit with the inside approximately square profile of the inside of the ground stake. The preferred cross-section of the lower section is generally in the form of an "X" (see e.g., FIG. 9) extending diagonally between opposite corners of the approximately square outer profile. The X-shaped cross-section is provided with clearance holes 30C sized and positioned to receive the angled fasteners 18. The bottom 34E of the lower section is configured to provide additional stiffness to the bottom of the X-shaped cross-section thereof, and in the embodiment shown, is generally solid, with a planar or plate form to close the bottom of the coupling.

The outside profile of the upper section 36 is sized to slide into the bottom of the sign post 14, to a depth of preferably at least approximately two to three inches. The cross-section outside profile of the upper section is configured to prevent rotation of the coupling in the sign post. The inside profile of the upper section is configured for allowing angle threaded fasteners 18 to extend therethrough and through aligned holes 14C in the sides of the sign post. The preferred outer profile of the upper section is an approximately square profile perpendicular to the center axis thereof for a snug fit with the inside approximately square profile of the inside of the sign post. The preferred cross-section of the upper section is generally in the form of an "X" (see e.g., FIG. 8) extending diagonally between opposite corners of the approximately square outer profile. The X-shaped cross-section is provided with clearance holes 30C sized and positioned to receive the angled fasteners 18. The top 36D of the upper section is configured to provide additional stiffness to the top of the X-shaped cross-section thereof, and in the embodiment shown, is generally solid, with a planar or plate form to close the top of the coupling.

The outside profile of the center section 32 is sized to establish shoulders or surfaces to rest onto the top of the ground stake 12, and establish position stops for installing the coupling 30 into the ground stake and the sign post 14 onto the coupling. The preferred center section is a generally solid, planar or plate form to provide additional stiffness to the top of the X-shaped cross-section of the coupling lower section 34, and to the bottom of the X-shaped cross-section of the coupling upper section 36. The score formation 38 is provided at the four extremities of the X-shaped profile transitioning between the upper section and the center section, and extending inwardly into the transition radius material therebetween. The score formation is established with a notch or groove formed into said transition around 360 degrees to establish a shear-off weakening location when the sign post and coupling are impacted from any angle around 360 degrees. In the embodiment shown, this results in the score formation being provided at the four corners of the X-shaped profile transition between the upper and center sections.

In use, the lower section 34 of the coupling 30 is inserted into the top of the ground stake 12 until the center section 32 is preferably resting on the top of the ground stake (see FIG. 15). The coupling is secured in the ground stake with angled fasteners 18 installed through the aligned clearance holes 12C, 30C in the sides of the ground stake and the lower section of the coupling. The bottom of the sign post 14 is then installed over the upper section 36 of the coupling until the bottom of the post preferably rests on the coupling center section 32, and is secured in position with angled fasteners installed through aligned clearance holes 14C, 30C in the sides of the post and the upper section of the coupling.

Figure 16:
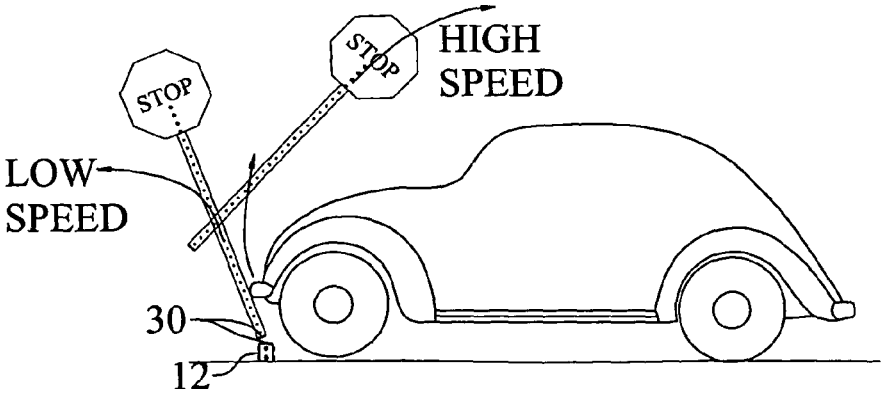
FIG. 16 is a view of two breakaway scenarios associated with an automobile striking into the stop sign post installed with the breakaway coupling according to the invention.

With this arrangement, the upper section 36 of coupling will shear off at the score formation 38, located at the transition interface between the upper and center section, if the sign post is struck by an automobile having a speed of at least between approximately 15 to 20 miles per hour. As a result of the uniquely configured coupling 30, the sign post 14 and stop sign 16 will be typically propelled safely away from the vehicle, thereby protecting the automobile from further damage and its occupants from potential injury directly resulting from the stop sign moving as a result of striking the sign post. When a vehicle strikes the sign post at a relatively low speed, such as at a speed of less than approximately 20 miles per hour, and preferably at most speeds less than approximately 20 miles per hour, the coupling will shear off and the sign post will be propelled forwardly from the car, as generally indicated by the "LOW SPEED" directional arrow in FIG. 16, and normally land to the side, out of the way of the moving vehicle and/or with the sign generally flat on the ground such that the vehicle will likely safely travel over the sign. When the vehicle strikes the sign post at a relatively high speed, such as at a speed of 30 miles per hour or greater, the sign post is propelled upwardly into the air, as generally indicated by the "HIGH SPEED" directional arrows in FIG. 16, such that the sign post flies over the top of the vehicle, and the vehicle continues safely past the location of the ground post. The signpost instantly shears off upon high speed impact. At this point the signpost loses all of its energy and remains in the same local of its attachment (the ground stake). The forward motion is converted to "rotational motion". The sign acts as an air break and slows the rotation of the signpost and the vehicle can pass beneath the sign. Then the signpost will instantly lay close to its original attachment. Current signposts do not shear off, and they retain energy at impact. This is why present signposts conform to the shape of the vehicle and enter the windshield or roof.

The transition between the sign post being thrown forwardly and being thrown up into the air will depend on the precise shear characteristics of the coupling provided, and will occur at some speed between approximately fifteen miles per hour and 61 miles per hour. These shear performance characteristics of the coupling, and the resulting action of the sign post, is a result of the coupling shearing relatively quickly, i.e., virtually instantaneously. In the event of a higher speed impact, this fast-acting shearing of the coupling results in the bumper of the vehicle propelling the sign post quickly up into the air.

From the foregoing, it will be apparent that the coupling 30 is uniquely adapted for use and installation or retrofit to conventionally, previously installed stop signs without modification to either the sign post or the ground stake. All that is required is the breakaway coupling, and an additional set of angled fasteners.

One preferred breakaway coupling 30 is produced as a one-piece article with a sand casting procedure, and is made from ASTM A4B Grey Iron Class 35. The preferred dimensions of such a coupling for use with an approximately 2"×2" sign post are briefly described below. These preferred dimensional relationships have been developed to provide quick breakaway characteristics as discussed above for this preferred material. In this instance, the outer profile of the upper section 36 is approximately one and three-fourths (1¾) inch square to fit snugly into the post 14. The center section is approximately two and one-fourth (2¼) inch square and approximately one-fourth (¼) inch thick. The outer profile of the lower section 34 is approximately two (2) inches square to fit snugly into the anchor 12. The overall height of the coupling is approximately six (6) inches, split evenly on either side of the center section. One leg of the X-shape cross-section of the upper and lower sections is provided with a thickness T1 of approximately one-eight (⅛) (to three-sixteenths (3/16)) inch. This web leg is formed continuous and solid. The other leg of the X-shape cross-section of the upper and lower sections is provided with a thickness T2 of approximately one-half (½) inch thick. This web leg is provided with approximately one-fourth (¼) (to three-eighths (⅜)) inch diameter clearance holes 30C on each side, spaced axially at one inch between centers. The additional thickness of the second web leg provides sufficient strength to this web leg, with the clearance holes formed therein, to generally match the strength of the thinner web leg without the clearance holes. The coupling is further provided with a transition fillet radius between the upper section and the center section of approximately ⅜ inch. The score formation 38 is formed on a root diameter extending around the part, and is cut at a size of approximately one thirty-seconth (1/32) inch tall by one thirty-seconth (1/32) inch deep into the fillet radius transition material. Testing of the breakaway coupling indicates that the precise size or depth of the score formation 38 is not critical, but the presence of a score formation at the transition between the upper and center sections is important to provide a fast shear action when the sign post is struck by an automobile.

Testing of the breakaway coupling in accordance herewith shows that it meets the breakaway standards set forth in NCHRP Report 350 for such road signs at all vehicle speed test conditions when struck from any angle around 360 degrees. Breakaway couplings in accordance with the invention have been tested and approved for, and can be used in accordance herewith, for both one-post sign installations such as shown in the drawings, and two-post sign installations such as used to hold larger directional or informational signs at the sides of roadways.

As those skilled in the art will recognize, the breakaway coupling may be provided in alternate configurations, with alternate materials and sizes, and alternate dimensions, and for alternate size sign posts, to meet the impact shear strength and performance as taught herein. Those skilled in the art will also understand that designation of a stop sign herein will include other types of road-side signs, and signs generally installed as shown and described herein with a separate ground stake or its equivalent, and a post that telescopes into the ground stake.

As further illustration, an alternate breakaway coupling 40 configured for use with U-channel posts, is shown in the drawings in FIGS. 17-20. In accordance with the invention, the coupling 40 establishes a clean breakaway of a sign post 54 (FIG. 19) and road-side sign (not shown) from the ground stake 52 if the sign post is struck with an automobile. The breakaway coupling 40 is configured as provided below to shear if the sign post is struck with an automobile having a speed of at least approximately 15 miles per hour, or greater, and is preferably configured to breakaway when struck by an automobile at virtually any speed.

Figure 17:
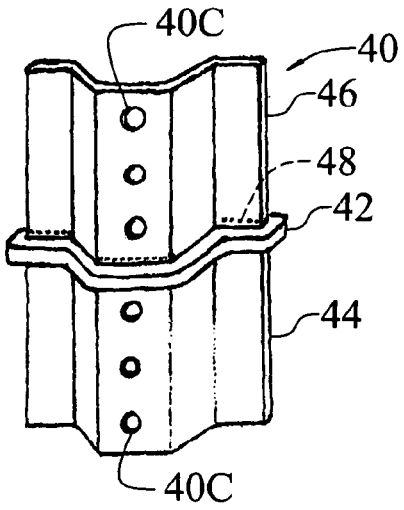
FIG. 17 is a perspective view of an alternate breakaway coupling in accordance with the invention.
Figure 18:
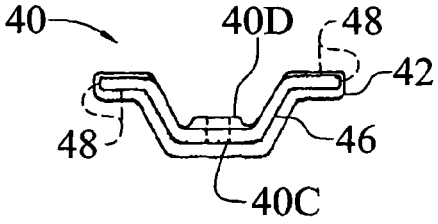
FIG. 18 is a top view of the alternate breakaway coupling.

The coupling 40, as shown in detail in FIGS. 17-18, includes a center section 42 with top and bottom shoulders or generally planar oppositely facing (up and down) surfaces, a lower section 44 extending downwardly from the bottom of the center section, an upper section 46 extending upwardly from the top of the center section, and a score formation 48 extending around the coupling at the transition interface between the top and center sections. The preferred coupling is manufactured as a one-piece unit, with the upper section and lower section of the coupling being integrally molded together.

Figure 20:
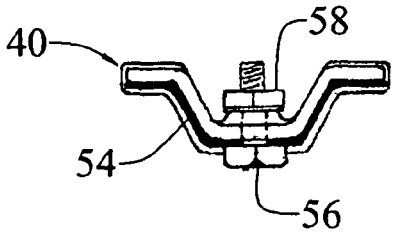
FIG. 20 is a top view of the coupling and post shown in FIG. 19.

The front side profile of the lower section 44 is provided with the same shape as and to interface directly with the back side profile of the U-shaped channel anchor 52 (see FIG. 20 showing a top view of the coupling 40 and post 54, the bottom view being a mirror image thereof), to a depth of preferably at least approximately two to three inches. The cross-section of the lower section is a substantially constant thickness from front to back. The lower section includes through holes 40C and optional aligned bosses on the back side so that threaded fasteners 56 extend therethrough and through aligned holes in the ground stake 52 top for securing the coupling to the ground stake with the fasteners and threaded nuts 58. The front side of the upper section 46 is provided with the same shape as and to interface directly with the back side profile of the U-shaped sign post 54 (see FIG. 20), to a height of preferably at least approximately two to three inches. The cross-section of the upper section is substantially constant from front to back. The upper section also includes through holes 40C and optional aligned bosses on the back side for threaded fasteners 56 to extend therethrough and through aligned holes in the sign post, and securing thereto with threaded nuts 58. The front side profiles of the upper and lower sections are preferably shaped for a snug fit to the back sides of the anchor and sign post. In one embodiment, the preferred thickness of the upper and lower sections, and particularly at the transition between the center and upper sections, is approximately five-sixteenths (5/16) inch. The outside profile of the center section 42 tracks the U-shape channel of the upper and lower sections, is sized outwardly therefrom in at least the forward direction to establish shoulders or surfaces to rest onto the top of the ground stake 52, and establish position stops for installing the coupling 40 into the ground stake and the sign post 54 onto the coupling. The preferred center section is a generally solid, planar or plate form to provide additional stiffness at the interface between the upper and lower sections. In this instance, the score formation 48 is formed around the entire coupling (front, back and sides). The score formation 48 is similar to the score formation 38 discussed above, at the location transitioning between the upper section and the center section. Where a transition radius material is provided as described above for coupling 30, the score formation extends inwardly into the transition radius material. The score formation is established with a notch or groove formed into said transition around 360 degrees to establish a shear-off weakening location when the sign post and coupling are impacted from any angle around 360 degrees. In this alternate embodiment, this results in the score formation being provided around the entire U-shaped profile transition between the upper and center sections of the entire coupling.

Figure 19:
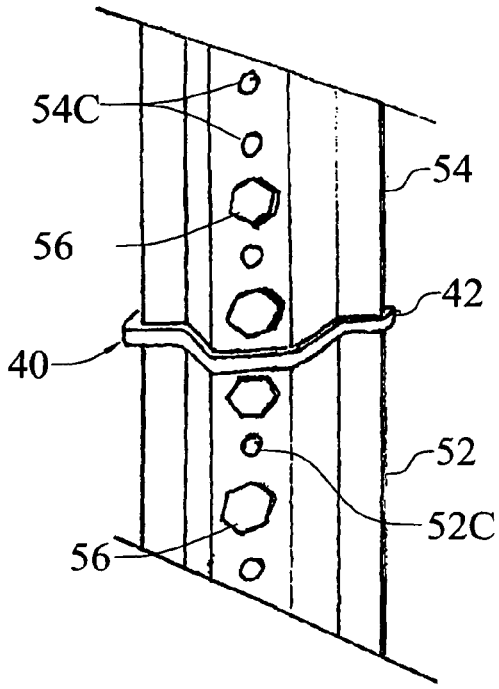
FIG. 19 is a fragmentary front view showing the alternate breakaway coupling of FIGS. 17-18 secured to a ground stake and a post secured to the coupling.

In use, the lower section 44 of the coupling 40 is positioned against the top of the ground stake 52 until the center section 42 is preferably resting on the top of the ground stake (see FIG. 19). The coupling is secured in the ground stake with fasteners 56 installed through the aligned clearance holes 52C, 40C in the sides of the ground stake and the lower section of the coupling, with nuts 58 secured against the back of the coupling. The bottom of the sign post 54 is then installed against the upper section 46 of the coupling until the bottom of the post preferably rests on the coupling center section 42, and is secured in position with fasteners installed through aligned clearance holes 54C, 40C in the sides of the post and the upper section of the coupling, with nuts 58 secured against the back of the coupling. The upper section 46 of coupling 40 will instantly shear off at the score formation 48 located at the transition interface between the upper and center section, if the sign post is struck by an automobile, and as described above with coupling 30, thereby preventing the sign post and sign from endangering the vehicle and its occupants.

Figure 22:
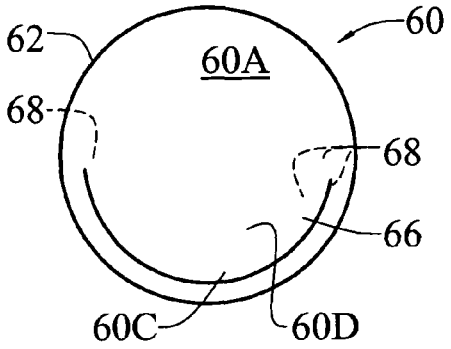
FIG. 22 is a top view of the second alternate breakaway coupling shown in FIG. 20, the bottom view being a mirror image thereof.
Figure 21:
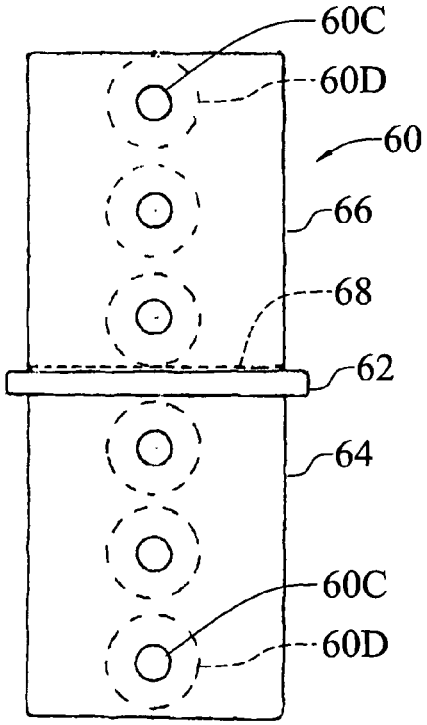
FIG. 21 is a front view of a second alternate breakaway coupling in accordance with the invention.
Figure 23:
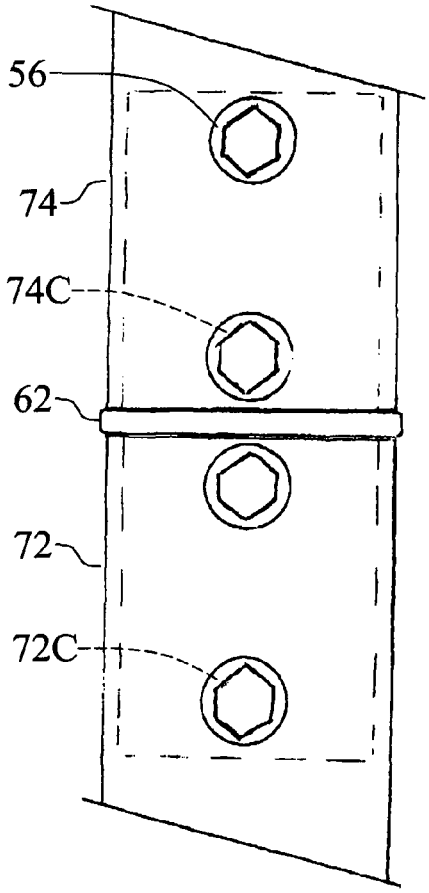
FIG. 23 is a fragmentary front view showing the second alternate breakaway coupling of FIGS. 21-22 secured to a ground stake and a post secured to the coupling.

As still further illustration, a second alternate breakaway coupling 60 configured for use with round tubular posts, is shown in the drawings in FIGS. 21-23. In accordance with the invention, the coupling 60 establishes a clean breakaway of a sign post 74 (FIG. 23) and road-side sign (not shown) from the ground stake 72 if the sign post is struck with an automobile. The breakaway coupling 60 is configured as provided below to shear if the sign post is struck with an automobile having a speed of at least approximately 15 miles per hour, or greater, and is preferably configured to breakaway when struck by an automobile at virtually any speed.

The coupling 60, as shown in detail in FIGS. 21-22, includes a center section 62 with top and bottom shoulders or generally planar oppositely facing (up and down) surfaces, a lower section 64 extending downwardly from the bottom of the center section, an upper section 66 extending upwardly from the top of the center section, and a score formation 68 extending around the coupling at the transition interface between the top and center section. The preferred coupling is manufactured as a one-piece unit, with the upper section and lower section of the coupling being integrally molded together.

The outside profile of the lower section 64 is sized to slidably telescope into the top of the ground stake 72, to a depth of preferably at least approximately two to three inches. In this instance, the inside profile of the lower section is provided with threaded bosses 60D to receive threaded fasteners 56 when installed through aligned holes 72C in the sides of the ground stake. The outer profile of the lower section is semi-circular for a snug fit with the inside round profile of the ground stake. The preferred cross-section of the lower section is generally semi-circular (see e.g., FIG. 21 which shows a top view, the bottom view being a mirror image thereof, extending around approximately 180 degrees. The outside profile of the upper section 66 is sized to slide into the bottom of the sign post 74, to a depth of preferably at least approximately two to three inches. The inside profile of the upper section is provided with threaded bosses 60D to receive threaded fasteners 56 when installed through aligned holes 74C in the sign post. The preferred outer profile of the upper section is semi-circular for a snug fit with the inside round profile of the sign post. The preferred cross-section of the upper section is also semi-circular, again extending around approximately 180 degrees, particularly at the transition with the center section 62. In one embodiment, the preferred thickness of the upper and lower sections, and particularly at the transition between the center and upper sections, is approximately five-sixteenths (5/16) inch.

The outside profile of the center section 62 is round, extending radially outwardly from the radial size of the upper and lower sections, and sized to establish shoulders or surfaces to rest onto the top of the ground stake 72, and establish position stops for installing the coupling 60 into the ground stake and the sign post 74 onto the coupling. The preferred center section is a generally solid, planar or plate form to provide additional stiffness at the interface between the upper and lower sections. In this instance, the score formation 68 is provided around 360 degrees of the entire coupling. The score formation 68 is similar to the score formation 38 discussed above, at the location transitioning between the upper section and the center section. Where a transition radius material is provided as described above for coupling 30, the score formation extends inwardly into the transition radius material. The score formation is established with a notch or groove formed into said transition around 360 degrees (i.e., the front, back and sides of the semi-circular, semi-annular cross-section) to establish a shear-off weakening location when the sign post and coupling are impacted from any angle around 360 degrees. In this second alternate embodiment, this results in the score formation being provided around the entire annular-shaped outer profile transition between the upper and center sections of the entire coupling.

In use, the lower section 64 of the coupling 60 is positioned against the top of the ground stake 72 until the center section 62 is preferably resting on the top of the ground stake (see FIG. 22). The coupling is secured in the ground stake with fasteners 56 installed through the aligned clearance holes 72C, 60C in the sides of the ground stake and the lower section of the coupling. The bottom of the sign post 74 is then installed against the upper section 66 of the coupling until the bottom of the post preferably rests on the coupling center section 62, and is secured in position with fasteners installed through aligned clearance holes 74C, 60C in the sides of the post and the upper section of the coupling. The upper section 66 of coupling 60 will instantly shear off at the score formation 68 located at the transition interface between the upper and center section, if the sign post is struck by an automobile, and as described above with coupling 30, thereby preventing the sign post and sign from endangering the vehicle and its occupants.

From the foregoing, it will be apparent that the present invention brings to the art a new and unique coupling which virtually eliminates the risk of occupant injury, and reduces damage to vehicles, in that at speeds over approximately 30 mph, it instantly shears off permitting the vehicle to pass beneath the signpost and also does not disfigure the ground stake. At slow speeds, the coupling also shears off permitting the signpost to fall forward with no damage to the ground stake or to the vehicle. This also results in savings of time and money for the roadway maintenance crews in repairing and replacing damaged signposts.

We claim:

1. A breakaway coupling for securing a sign post with a tubular bottom to a ground stake with a tubular top, the coupling comprising:

a) a generally planar center section, b) an upper section extending upwardly from the center section, i) the upper section being configured for telescoping interface into the hollow bottom end of the post, c) a lower section extending downwardly from the center section, i) the lower section being configured for telescoping interface into the hollow top end of the ground stake, d) a breakaway score established at and extending inwardly into the transition between the center section and one of the upper and lower sections, said one section having a generally X-shaped cross-section; and e) means for securing the upper and lower sections into telescoping position inside the bottom of the sign post and the top of the ground stake, respectively, wherein the center section extends outwardly in relation to the upper and lower sections to establish a shoulder capable of resting against the top of the ground post when the lower section is secured thereto and capable of engaging the bottom of the sign post when the upper section is secured thereto; and wherein the upper and lower sections are formed with outer profiles each having four equally spaced corners and side portions extending at right angles therefrom to establish overall approximately square cross-sections for telescoping into an approximately square tubular sign post bottom and an approximately square tubular ground stake top, respectively, in which said X-shaped cross-section of said one section is established with first and second legs extending between corresponding opposite corners and merging in the middle, and in which said score is established in the transition between the center section and said one section at all four of said corners and the side portions extending therefrom but not in said legs.

2. The coupling as defined in claim 1 in which the upper and lower sections are formed with substantially closed top and bottom, respectively.

3. The coupling as defined in claim 1 in which the upper, center and lower sections are integrally molded from ASTM A4B Grey Iron.

4. The coupling as defined in claim 1 in which one of said legs of the upper and lower sections are provided with clearance holes for said securing means to pass through, the thickness of said one legs being thicker than the other of said legs to establish approximately equal material strength shear of said legs.

5. A breakaway coupling for securing a sign post having a bottom with first and second oppositely facing sides to a ground stake having a top with third and fourth oppositely facing sides, the coupling comprising:

a) an upper section having a first side with a profile complimentary to the first side of the sign post for substantial face-to-face engagement therewith;

b) a lower section having a third side with a profile complimentary to the third side of the ground stake for substantial face-to-face engagement therewith;

c) a generally planar center section integrally established between the upper and lower sections, the center section extending outwardly from the first and third sides of the upper and lower sections, respectively, to establish a shoulder capable of resting against the top of the ground post when the lower section is in said engagement therewith and capable of engaging the bottom of the sign post when the upper section is in said engagement therewith; and d) means for removably securing said upper and lower sections into said engagement with the sign post and ground stake, respectively;

e) the transition between the center section and one of said upper and lower sections having a reduced wall thickness as compared to the wall thickness at the transition between the center section and the other of said upper and lower sections to establish a shear plane at the reduced wall thickness transition said one section having a generally X-shaped cross-section through said shear plane.

6. The coupling as defined in claim 5 in which one of said legs of the upper and lower sections are provided with clearance holes for said securing means to pass through, the thickness of said one legs being thicker than the other of said legs to establish approximately equal material strength shear of said legs.

7. The coupling as defined in claim 6 in which the upper and lower sections are formed with substantially closed top and bottom, respectively.

8. The coupling as defined in claim 7 in which the upper, center and lower sections are integrally molded from ASTM A4B Grey Iron.

9. The coupling as defined in claim 8 in which the outer profile of the upper section is approximately one and three-fourths (1¾) inch square, the center section is approximately two and one-fourth (2¼) inch square and approximately one-fourth (¼) inch thick, the outer profile of the lower section is approximately two (2) inches square, the overall height upper, center and lower section is approximately six (6) inches with the upper and lower sections having approximately the same height, said one legs are provided with a thickness of approximately one-half (½) inch, and the other of said legs are provided with a thickness of approximately one-eight (⅛) inch, and said one legs are provided with approximately one-fourth (¼) inch diameter clearance holes on each side.

10. A breakaway coupling for securing a sign post with a tubular bottom to a ground anchor, the coupling comprising:

a) a generally planar center section, b) an upper section extending upwardly from the center section, i) the upper section having a generally X-shaped cross-section, ii) the upper section being configured for telescoping interface into the hollow bottom end of the post, c) a breakaway score established at and extending inwardly into the transition between the center section and the upper section, d) means for releasably securing the center section to the ground anchor, and e) means for securing the upper section into telescoping position inside the bottom of the sign post;

wherein the center section extends outwardly in relation to the upper section to establish a shoulder capable of engaging the bottom of the sign post when the upper section is secured thereto, the upper section is formed with an outer profile having four corners and side portions extending at right angles therefrom, said X-shaped cross-section is established with first and second legs extending between opposite corners and merging in the middle, and said score is established in the transition between the center section and the upper section at all four of said corners and the side portions extending therefrom but not in said legs.

11. The coupling as defined in claim 10 wherein the upper section is formed with a rectangular outer profile when viewed from above for telescoping into an approximately rectangular tubular sign post bottom.

12. The coupling as defined in claim 10 in which the upper section is formed with a substantially closed top.

13. The coupling as defined in claim 10 in which one of said legs of the upper and lower sections are provided with clearance holes for said means for securing the upper section into the sign post to pass through, the thickness of said one legs being thicker than the other of said legs to establish approximately equal material strength shear of said legs.

14. The coupling as defined in claim 10 in which the upper and center sections are integrally molded from ASTM A4B Grey Iron.

* * * * *